United States Patent [19]

Tubbs

[11] 4,086,668

[45] May 2, 1978

[54] WATER CLOSET

[76] Inventor: Elton H. Tubbs, 162 N. Portage St., Westfield, N.Y. 14787

[21] Appl. No.: 704,248

[22] Filed: Apr. 12, 1976

[51] Int. Cl.[2] ..... E03D 11/02

[52] U.S. Cl. ..... 4/425; 137/846

[58] Field of Search ..... 4/10, 14, 15, 69, 70, 4/73, 76, 89; 137/517, 846, 853

[56] References Cited

U.S. PATENT DOCUMENTS

| | | | |
|---|---|---|---|
| 2,793,371 | 5/1957 | LeVesconte | 4/76 |
| 3,044,077 | 7/1962 | Belden | 4/10 |
| 3,047,013 | 7/1962 | Baumbach | 4/76 X |
| 3,224,013 | 12/1965 | Tubbs | 4/15 |
| 3,591,869 | 7/1971 | Manning | 4/69 |
| 3,901,265 | 8/1975 | Groombridge | 137/846 X |
| 3,967,645 | 7/1976 | Gregory | 137/846 |

*Primary Examiner*—Richard E. Aegerter
*Assistant Examiner*—Stuart S. Levy
*Attorney, Agent, or Firm*—Charles L. Lovercheck

[57] ABSTRACT

A water closet made up of a toilet bowl having flush nozzles around its rim and a flexible tube supported in the outlet pipe hanging down therein with a loose lower end for assisting in the flushing of the water closet. A separate behind valve supplies water to the rim and to the outlet.

4 Claims, 5 Drawing Figures

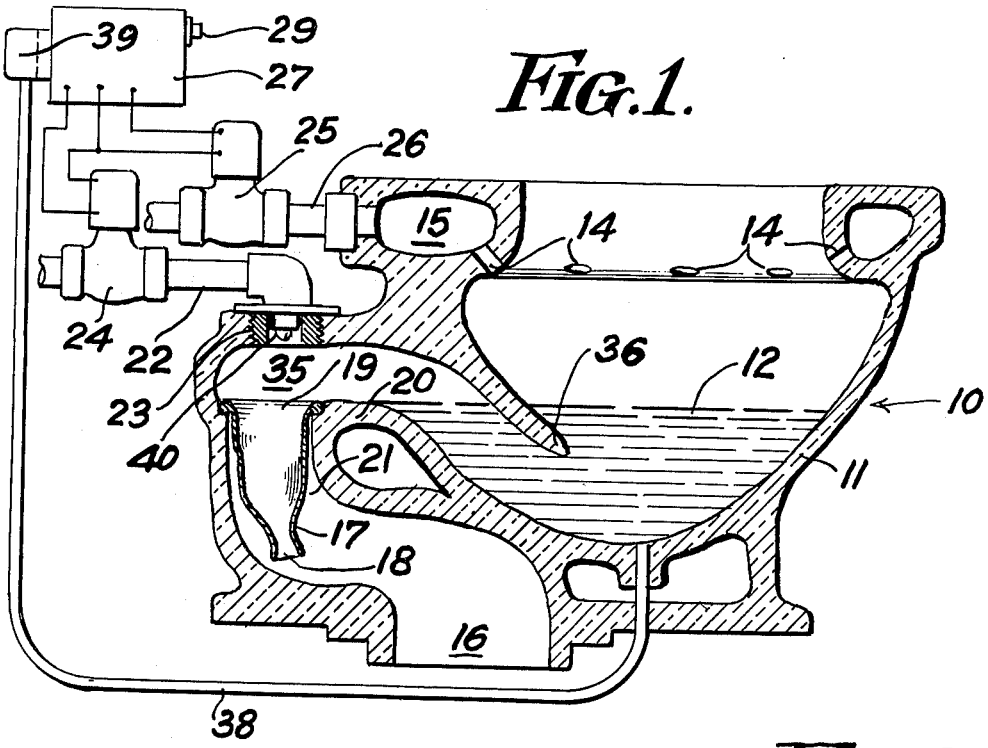
FIG. 1.
FIG. 3.
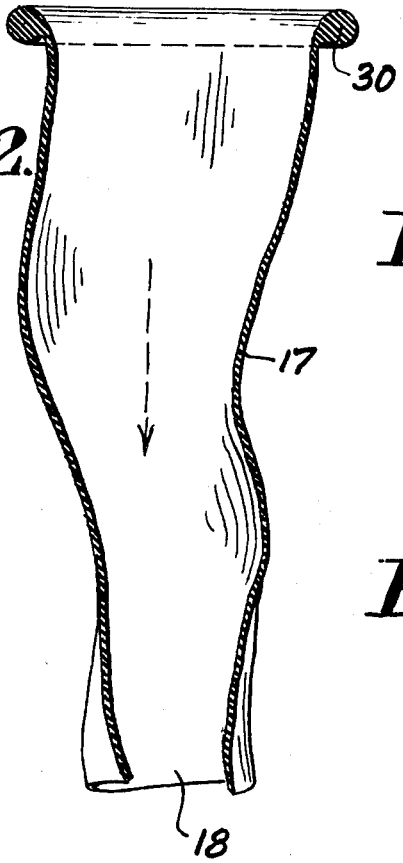
FIG. 2.
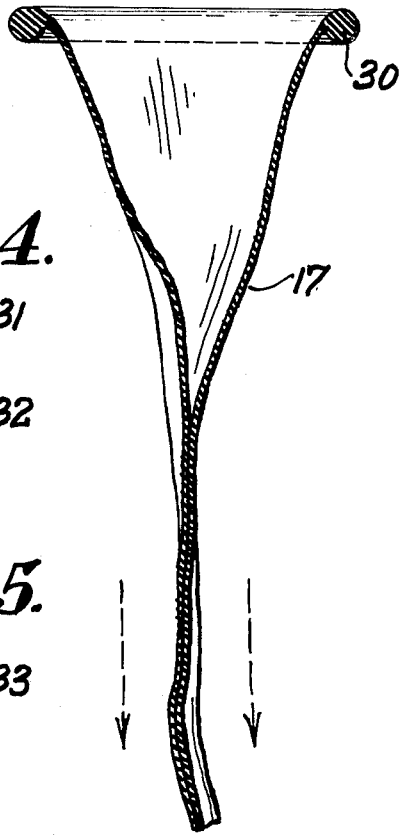
FIG. 4.
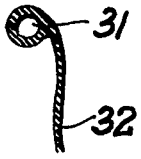
FIG. 5.
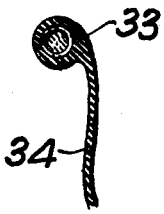

WATER CLOSET

REFERENCE TO PRIOR ART

The water closet disclosed herein constitutes an improvement over the siphonic flush commode disclosed in my U.S. Pat. No. 3,224,013, issued Dec. 21, 1965.

OBJECTS OF THE INVENTION

It is an object of the invention to provide an improved siphonic flush commode.

Another object of the invention is to provide an improved water closet.

Another object of the invention is to provide a siphonic flush commode that is simple in construction, economical to manufacture and simple and efficient in operation.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

GENERAL DESCRIPTION OF THE DRAWINGS

FIG. 1 is a longitudinal cross-sectional view of a siphonic flush commode according to the invention.

FIG. 2 is an enlarged cross-sectional view of the flexible tube which may be supported in the outlet of the commode showing the lower end of the tube open.

FIG. 3 is a view similar to FIG. 2 showing the lower end of the tube pulled together as with water flowing therethrough.

FIG. 4 is a partial cross-sectional view of another embodiment of the sleeve.

FIG. 5 is yet another embodiment of the sleeve.

DETAILED DESCRIPTION OF THE DRAWINGS

Now, with more particular reference to the drawing, the siphonic flush commode indicated generally at 10 is of the general type familiar to those skilled in the art which has a bowl 11 providing a sump for a fixed supply of water adapted to reach a water level 12 determined by the height of the partition 20.

Rim nozzles 14 are supplied water through waterway 15 which water, when supplied, will increase the height of water level 12 causing it to overflow the partition 13 into the outlet 16 which may be connected to a suitable drainage line. The flexible tube 17 has an open lower end 18, and an open upper end 19 with a relatively rigid ring at 30 for supporting it in the downwardly-extending part 21 of the outlet line 16.

Water for the outlet is supplied through a line 22 which is connected to an opening 23 in the commode and has a solenoid operated valve 24. The solenoid valve 25 connects water by way of pipe 26 to the waterway 15 and both valves 24 and 25 are controlled for sequence and timing to the control unit 27 which will be constructed of a type familiar to those skilled in the art.

In operation, the operator will actuate the push button 29 which will open the valve 25 4 seconds, for example, and then will close. Then valve 24 will be operated for 3 seconds, for example, and will then close. Then valve 25 is reactuated for a period of 4 seconds, for example. When the water first flows through the jet nozzles 14 into the sump, it rinses the inside of the bowl and raises the water level 12, causing the water to overflow partition 20 through the flexible tube 17 and out its lower end. After a pretimed time, a relay in control box 27 turns off valve 25 and turns on valve 24. Valve 24 turns on, causing a jet spray 40 to turn on. The jet spray sprays through nozzle 40, down flexible tube 17, causing the lower end of flexible tube 17 to be drawn together as the water flows through it, thus causing the water 12 to drain from the bowl, down the flexible tube 17. This action continues until the water in the bowl 12 is low enough to let air in below partition 36 which then breaks the vacuum and the water pressure on tube 38 reduces, allowing diaphragm 39 to close the proper switch which closes valve 25. At this point, valve 24 shuts off after a period of time of, for example, 4 seconds and is ready for the next cycle.

The tube 17 may be made of a relatively thin, flexible material such as a vinyl, polyethylene, rubber or similar material, and is suitable means for supporting the upper end of the tube 17 in the outlet such as an enlarged rim 30 which may be integrally supported on the tube. Any other suitable support such as spring 32, for example, could be used. FIG. 4 shows a flexible tube 32 connected to a ring 31 of more rigid material than tube 32 and molded into the tube material 32. FIG. 5 shows a helical spring 33 molded into the tube 34.

As water flows through the tube 17, venturi action causes the tube to collapse to the position shown in FIG. 3, thereby drawing water through the tube and increasing the velocity of flow through the tube 17 and applying greater suction to the water in tank 12. Both of the embodiments of FIGS. 4 and 5 provide a support that may be more suitable than FIG. 1 in some instances.

The foregoing disclosure eliminates the need of a second water trap such as the second trap at 11 in U.S. Pat. No. 3,224,013.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. In combination with a toilet bowl having a siphon forming outlet comprising, a bowl, said bowl having a sump for containing a quantity of water, a downwardly directed outlet for said bowl communicating with said bowl to receive fluids from said bowl during flushing thereof, a flexible open-ended tubular member in said outlet supported at its upper end and hanging downwardly therein and forming a flow path therethrough for said fluids whereby fluids flowing through said flexible tube cause the lower end of said tube to restrict the opening therethrough a jet nozzle adapted to be connected to the main water line under pressure said jet being supported above said flexible tube to direct water therethrough said flexible tube being adapted to be collapsed together by a differential in pressure between the pressure inside said tube and the pressure outside said tube thereby increasing the rate of flow of fluids by venturi action.

2. The combination recited in claim 1 wherein said bowl has rinsing nozzles disposed around said rim.

3. The combination recited in claim 2 wherein said flushing water supply means is supported in said closet for directing flush water downwardly into said outlet through said tubular member thereby increasing the flow rate through said tubular member.

4. The combination recited in claim 1 wherein a valve is connected in series with said supply of water and a pressure-sensitive means is connected to said sump and to said valve for turning off said valve when the pressure of said sump drops below a predetermined amount.

* * * * *